US007114277B2

(12) United States Patent
Valiulis et al.

(10) Patent No.: US 7,114,277 B2
(45) Date of Patent: Oct. 3, 2006

(54) SIGN HOLDER

(75) Inventors: Stanley C. Valiulis, Rockford, IL (US); Joseph E. Gormley, Rockford, IL (US); Craig Zadak, Roscoe, IL (US); Kirk Lewis, Lee's Summit, MO (US)

(73) Assignee: Southern Imperial, Inc., Rockford, IL (US)

( * ) Notice: Subject to any disclaimer, the term of this patent is extended or adjusted under 35 U.S.C. 154(b) by 219 days.

(21) Appl. No.: 10/864,654

(22) Filed: Jun. 9, 2004

(65) Prior Publication Data

US 2005/0274052 A1 Dec. 15, 2005

(51) Int. Cl.
*G09F 3/16* (2006.01)

(52) U.S. Cl. ..... 40/648; 40/666; 40/658; 40/661.07; 40/667; 403/329

(58) Field of Classification Search ..... 40/666, 40/658, 655, 648, 661.07, 661.11, 667, 649, 40/651, 652, 607.14, 611.12; 211/57.1; 24/453; 403/329

See application file for complete search history.

(56) References Cited

U.S. PATENT DOCUMENTS 1,435,785 A * 11/1922 Alexander ..... 248/165
1,440,846 A * 1/1923 Suhler ..... 40/606.03
2,859,546 A * 11/1958 Gutterson ..... 40/658
3,324,585 A 6/1967 Frederickson
3,530,605 A * 9/1970 Gutterson ..... 40/658
3,711,973 A * 1/1973 Slavsky ..... 40/658
3,714,724 A * 2/1973 Slavsky ..... 40/658
3,728,806 A * 4/1973 Kostiuk ..... 40/658
4,373,693 A * 2/1983 Greenberger ..... 248/220.22
4,485,575 A * 12/1984 Fast ..... 40/649
4,541,598 A * 9/1985 Villanueva et al. .... 248/222.12
4,829,689 A * 5/1989 Alshooler ..... 40/617
4,995,182 A * 2/1991 Fast ..... 40/649
5,375,803 A 12/1994 Kump
5,722,625 A * 3/1998 Kenney ..... 248/220.41
6,082,687 A * 7/2000 Kump et al. ..... 248/220.41
6,341,755 B1 * 1/2002 Kump ..... 248/220.41
6,354,546 B1 * 3/2002 Mueller ..... 248/220.42
6,651,369 B1 * 11/2003 Keating et al. ..... 40/658
D496,693 S * 9/2004 Mueller ..... D20/43

* cited by examiner

*Primary Examiner*—Gary C. Hoge
(74) *Attorney, Agent, or Firm*—Reinhart Boerner Van Deuren P.C.

(57) ABSTRACT

Provided is a sign holder for mounting to and displaying from a shelf any of various planar signs. The sign holder includes a clamp having two pivotally-connected panels that can be placed into a clamping position to hold the planar sign. To hold the panels in the clamping position, the first panel includes a holding prong that can be received in a corresponding aperture of the second panel. To prevent the planar sign from slipping between the panels, the second panel includes a piercing prong that can pierce the planar sign and be received in a corresponding aperture of the first panel. So that the planar material does not interfere with the engagement between the holding prong and its corresponding aperture, the piercing prong can be spaced-apart from the pivotally-connected edges of the panels a greater distance than the holding prong is. Various mounting structures can be included.

24 Claims, 5 Drawing Sheets

SIGN HOLDER

FIELD OF THE INVENTION

This invention generally pertains to a sign holder and more particularly to a sign holder adapted to be mounted to a shelf for displaying a planar sign.

BACKGROUND OF THE INVENTION

Often, to promote certain products, retailers will display planar paper signs on the shelves where such products are located at a retail establishment or retail store. For instance, grocery stores often have numerous signs displayed from various shelves that include information about the associated products such as price or nutrition. To securely hold and display the signs in a conspicuous location, sign holders are often used. The sign holder can be mounted to the shelf and includes a retaining structure that securely holds the sign. Various styles of sign holder retaining structures are known in the art. Desirably, the retaining structure not only secures the sign but allows for easy replacement of the sign so that the sign holder can be readily reused. Furthermore, to facilitate mounting the sign holder to the shelf, the shelf may include mounting features such as perforations disposed through the shelf or a channel extending from a front edge of the shelf.

BRIEF SUMMARY OF THE INVENTION

The invention provides a sign holder for holding and displaying a planar sign from a shelf in a retailer's store or establishment. The planar sign may be made from any planar material, such as paper or cardboard, and may include writing or illustrations thereon. To function as the retaining feature that holds the sign, the sign holder includes a clamp that is formed from a first panel and a second panel. Each of the first and second panels includes a proximate edge and a distal edge, with the first and second panels being pivotally connected together along their proximate edges. Accordingly, one of the panels can be pivotally moved to a position wherein the panels generally overlap one another, thereby providing a clamping action for grasping the planar sign placed between the panels. The sign holder also includes a mounting structure to mount the sign holder to a shelf.

To releasably hold the panels in the clamping position, there is included a holding prong projecting from an inner surface of the first panel. The holding prong can be received in a corresponding aperture disposed into an inner surface of the second panel when the first and second panels are pivoted into the clamping position. The holding prong and aperture engage each other in a snap-like relationship that allows the one panel to be pivoted apart from the other panel under the application of a sufficient force. In one aspect of the invention, to facilitate relative pivoting apart the first and second panels, a gripping tab or wing is included extending from the distal edge of at least one panel. The wing extends at an angled relationship from the panel such that the wing can be easily grasped or manipulated by a clerk's fingers to pry the panels apart.

To prevent the planar sign from slipping between the panels, there is included a piercing prong projecting from the inner surface of the second panel. The first panel includes a corresponding second aperture that can receive the piercing prong when the first and second panels are pivoted into the clamping position. The piercing prong includes a sharp tip that is adapted to pierce through the planar sign. The piercing prong pierces and projects through the planar sign preventing the sign from slipping between the panels. In one aspect of the invention, to appropriately position the planar sign between the panels for piercing, the piercing prong is spaced-apart from the connected proximate edges a greater distance than the holding prong is. Accordingly, when an edge of the planar sign abuts against the holding prong, the planar sign extends over the second aperture and is set to be pierced by the piercing prong.

These and other advantages and features of the invention will become apparent form the detailed description and the accompanying figures.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
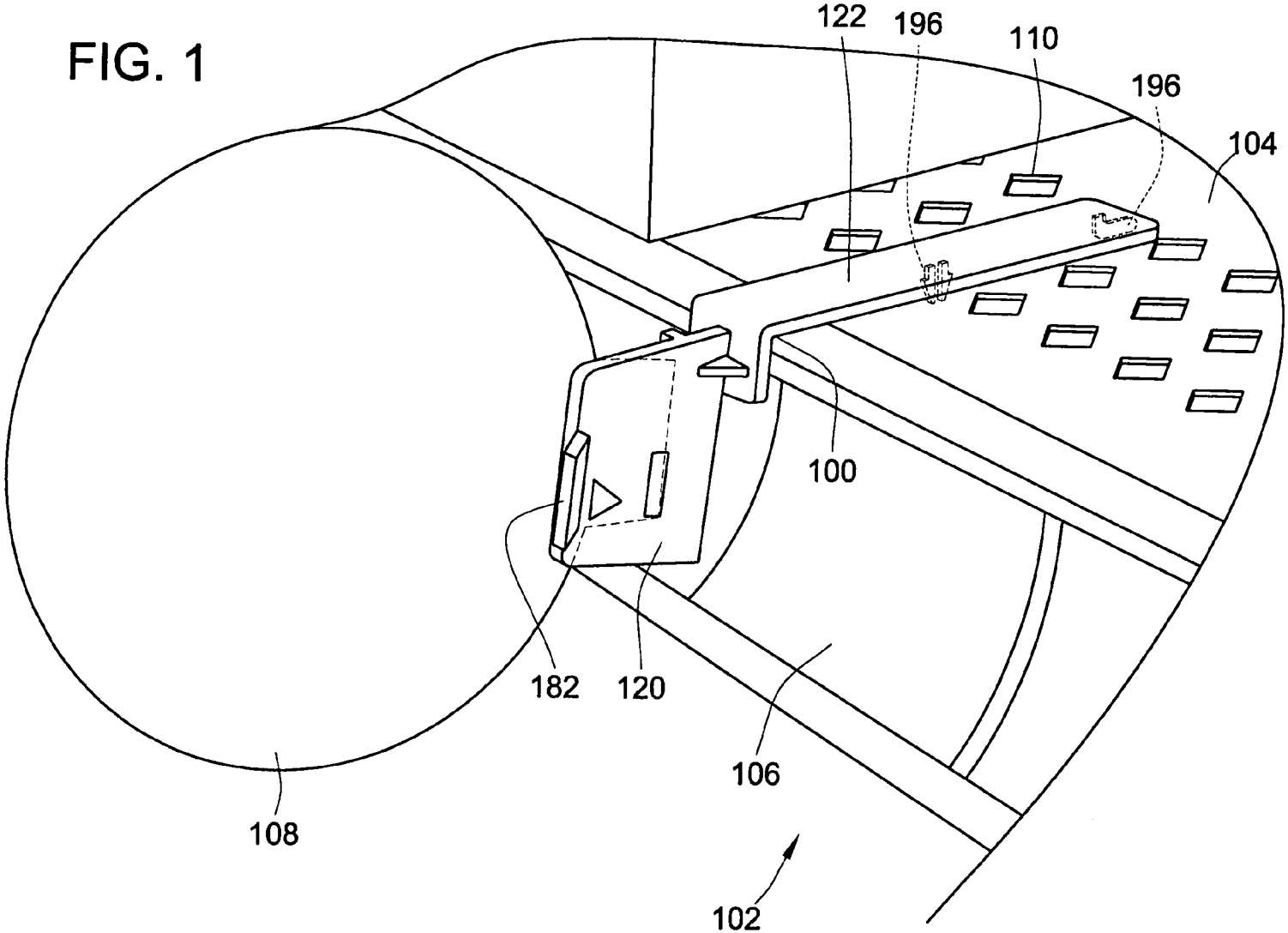
FIG. 1 is a perspective view of a sign holder mounted to a shelf and holding out for display perpendicularly from the shelf a planar sign.

Now referring to the drawings, wherein like reference numbers refer to like elements, there is illustrated in FIG. 1 a sign holder 100 mounted to a shelf 102 for displaying a planer sign 108. The shelf may be located at a retail environment where it is used to store and display any of a variety of products. The shelf 102 includes a horizontal ledge 104 and a downward projecting front edge 106 that extends along the horizontal ledge. To conspicuously display the planar sign 108, the sign holder 100 includes a clamp 120 that holds the sign from the front edge 106 of the shelf and a mounting leg 122 that mounts to the horizontal ledge 104. The sign holder 100 can be made from any suitable material such as, for example, molded polypropylene that, advantageously allows the sign holder to be used in low-temperature freezer cases. The planar sign 108 itself can be made from any planar material, such as paper or cardboard, and typically includes product information displayed thereon.

Figure 2:
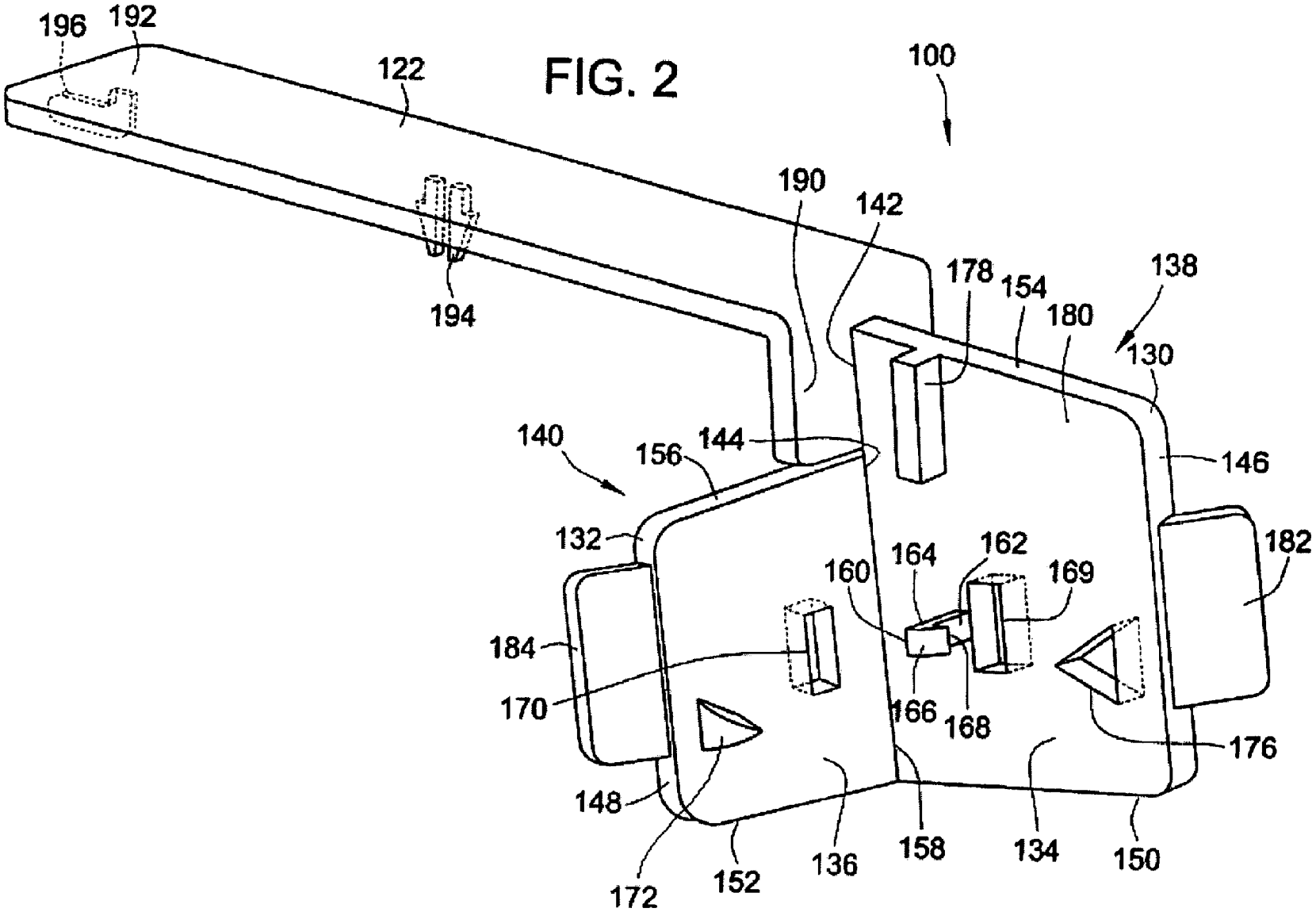
FIG. 2 is a perspective view of the sign holder separated from the shelf and with the planar sign removed.

Referring to FIG. 2, to form the clamp 120 that holds the planar sign, the sign holder 100 includes a generally planar first panel 130 and a generally planar second panel 132. Because of their planar shape, each panel 130, 132 has an inner surface 134, 136 and an opposing outer surface 138, 140. Furthermore, the panels 130, 132 each include a proximate edge 142, 144 along which the panels are connected and a spaced-apart distal edge 146, 148. To further define the outline of the first and second panels 130, 132, each panel also includes a first edge 150, 152 and a second edge 154, 156 that extend between the proximate edges 142, 144 and distal edges 146, 148.

To facilitate the clamping action that holds the planar sign, the first and second panels 130, 132 are pivotally connected at their proximate edges 142, 144. Preferably, the pivotal connection is accomplished by a living hinge 158 that extends between the first and second panels 130, 132 generally along the proximate edges 142, 144. Living hinges are well known to those of skill in the art and are generally formed as thin walls of flexible material that join and extend between two articles. The flexibility of the material allows the two articles to be repeatedly bent with respect to each other. In working the invention, the second panel 132 can be pivoted relative to the first panel 130 (which can be held stationary) into a clamping position wherein the inner surfaces 134, 136 of the first and second panels generally overlap each other and the distal edges 146, 148 are positioned adjacent to each other. It will be appreciated that any planer sign that is placed between the first and second panels 130, 132 can be clamped between the opposing inner surfaces 134, 136.

To releasably hold the first and second panels 130, 132 in the clamping position wherein they overlay one another, the first panel includes a holding prong 160 projecting generally perpendicularly from its inner surface 134. The holding prong 160 has a rectangular base portion 162 and terminates in a barbed hook 164 that has an inclined surface 166 sloping back toward the inner surface 134, thereby forming an undercut 168. To receive the holding prong 160 when the first and second panels 130, 132 are pivoted into the clamping position, there is disposed through the second panel between the inner and outer surfaces 136, 140 a first aperture 170. To align with each other, the holding prong 160 and the first aperture 170 are each spaced-apart from the proximate edges 142, 144 of their respective first and second panels 130, 132 a corresponding distance. In the illustrated embodiment, the first aperture 170 has a generally rectangular shape to accommodate the rectangular base portion 162 of the holding prong 160. In an embodiment, to facilitate forming the holding prong 160 during a molding process, the first panel 130 may include a molding passage 169 disposed through the first panel and proximate to the holding prong.

As will be appreciated from FIG. 2, when the second panel 132 is pivoted into the clamping position, the holding prong 160 projects through the first aperture 170 with the barbed hook 164 catching the outer surface 140 of the second panel. Specifically, to engage the holding prong 160 and the first aperture 170 in a snap-like relationship, the holding prong is made of a flexible material. Accordingly, when the holding prong 160 initially is inserted into the first aperture 170, the inclined surface 166 contacts an edge of the first aperture causing the holding prong to deflect with respect to the first aperture. As the inclined surface 166 and the undercut 168 that it forms pass the outer surface 140 of the second panel 132, the holding prong 160 recovers so that the undercut extends over the outer surface thereby catching the second panel. To release the first and second panels 130, 132, it will be appreciated that applying a sufficient force to pivot the second panel 132 apart from the first panel 130 will again cause the holding prong 160 to deflect with respect to the first aperture 170. That deflection allows the barbed hook 164 to pass into and slide through the first aperture 170.

Referring to FIG. 2, to prevent the planar sign from slipping out from between the clamped first and second panels 130, 132, the sign holder 100 also includes a piercing prong 172 that pierces through the planar sign. The piercing prong 172 projects from the inner surface 136 of the second panel 132 and, in the illustrated embodiment, is generally shaped as a tetrahedron with a sharp tip. To accommodate the piercing prong 172 when the second panel 132 is pivoted into the clamping position, the first panel 130 includes a corresponding second aperture 176 disposed between the inner and outer surfaces 134, 138. In the illustrated embodiment, the second aperture 176 is shaped as a triangle to receive the tetrahedron-shaped piercing prong 172. Accordingly, when the first and second panels 130, 132 overlap each other in the clamping position, the piercing prong 172 has pierced and projects through the planar sign and is furthermore received in the second aperture 176 thereby preventing the planar sign from slipping between the panels.

To align the planar sign for piercing, the first panel 130 preferably includes a stop 178. In the illustrated embodiment, the stop 178 is generally shaped as a rectangular projection and extends from the second edge 154 partially toward the first edge 150 of the first panel 130. The stop 178 corresponds to an exposed portion 180 of the first panel 130 that the second panel 132 does not overlay when the second panel is pivoted into the clamping position. To provide for the exposed portion 180, the distance between the first and second edges 150, 154 of the first panel 130 is greater than the distance between the first and second edges 152, 156 of the second panel 132. Because the panels 130, 132 are connected such that the first edges 150, 152 are aligned, the second edges 154, 156 are offset, thereby creating the exposed portion 180. Accordingly, no aperture is required to accommodate the stop 178 when the second panel is pivoted into the clamping position.

It will be appreciated from FIG. 2 that the piercing prong 172 and its corresponding second aperture 176 are spaced a greater distance from the connected proximate edges 142, 144 of the panel 130, 132 than the stop 178. Additionally, the holding prong 160 and its associated first aperture 170 are spaced-apart from the connected proximate edges 142, 144 the same distance as the stop 178.

Referring to FIG. 2, to align the planar sign within the sign holder 100, it will be appreciated that the planar sign is to be placed adjacent the inner surface 134 of the first panel 130 so that an edge of the planar sign abuts against the stop 178 and the rectangular base portion 162 of the holding prong 160. In this position, the planar sign will extend over the second aperture 176 and therefore aligns with the piercing prong 172. Moreover, because the planar sign abuts against the stop 178 and the rectangular base portion 162, the planar sign does not interfere with the engagement of the holding prong 160 and the first aperture 170. Thus, there is no interference with the snapping function which can provide more reliable snapping.

In an embodiment, to facilitate releasing the planar sign from the sign holder 100, one or more wings extend from clamp 120. Referring to FIG. 2, a first and a second wing 182, 184 extend from the respective first and second panels 130, 132. Specifically the wings 182, 184 extend from the distal edges 146, 148 at an angled relationship with respect to the first and second panels 130, 132 such that, when the second panel 132 is pivoted relative to the first panel 130 into the clamping position, the wings diverge from each other. In an embodiment, the wings may extend from the distal edges at an angle of approximately 50° with respect to the plane of the panel. Referring to FIGS. 1 and 2, it will be readily appreciated that the diverging wings 182, 184 can be easily grasped or manipulated by a retail clerk's fingers to pivot the clamp 120 apart.

To mount the sign holder to a shelf, various types of mounting structures can be included as part of the sign holder. For example, referring to FIG. 2, the mounting structure is an elongated mounting leg 122 that extends from the clamp 120 between a clamp end 190 and a terminal end 192. A pair of mounting barbs 194 projects downward from the mounting leg 122 intermediately between the clamp and terminal ends 190, 192. Additionally, a mounting foot 196 also projects downwardly near the terminal end 192 of the mounting leg 122. Referring to FIG. 1, when the mounting leg 122 is placed adjacent the horizontal ledge 104, the mounting prongs 194 and mounting foot 196 can be received in perforations 110 disposed into the horizontal ledge.

To hold the planar sign 108 perpendicularly from the front edge 106 of the shelf 102, as illustrated in FIG. 1, the clamp 120 is arranged to extend outward from the clamp end 190 of the mounting leg 122. Specifically, referring to FIG. 2, the clamp end 190 is fixedly joined to the proximate edge 144 of the first panel 130 with the distal edge 146 offset by the first and second edges 150, 154. The mounting leg 122 therefore extends generally coplanar to the plane defined by the first panel 130. Moreover, because the clamp end 190 and the first panel 130 are connected only along the portion of the proximate edge 142 that corresponds to the exposed portion 180, the second panel 132 is free to pivot with respect to the mounting leg 122. Accordingly, when the second panel 132 is pivoted into the clamping position, the panels 130, 132 extend outward from the mounting leg 122.

Figure 3:
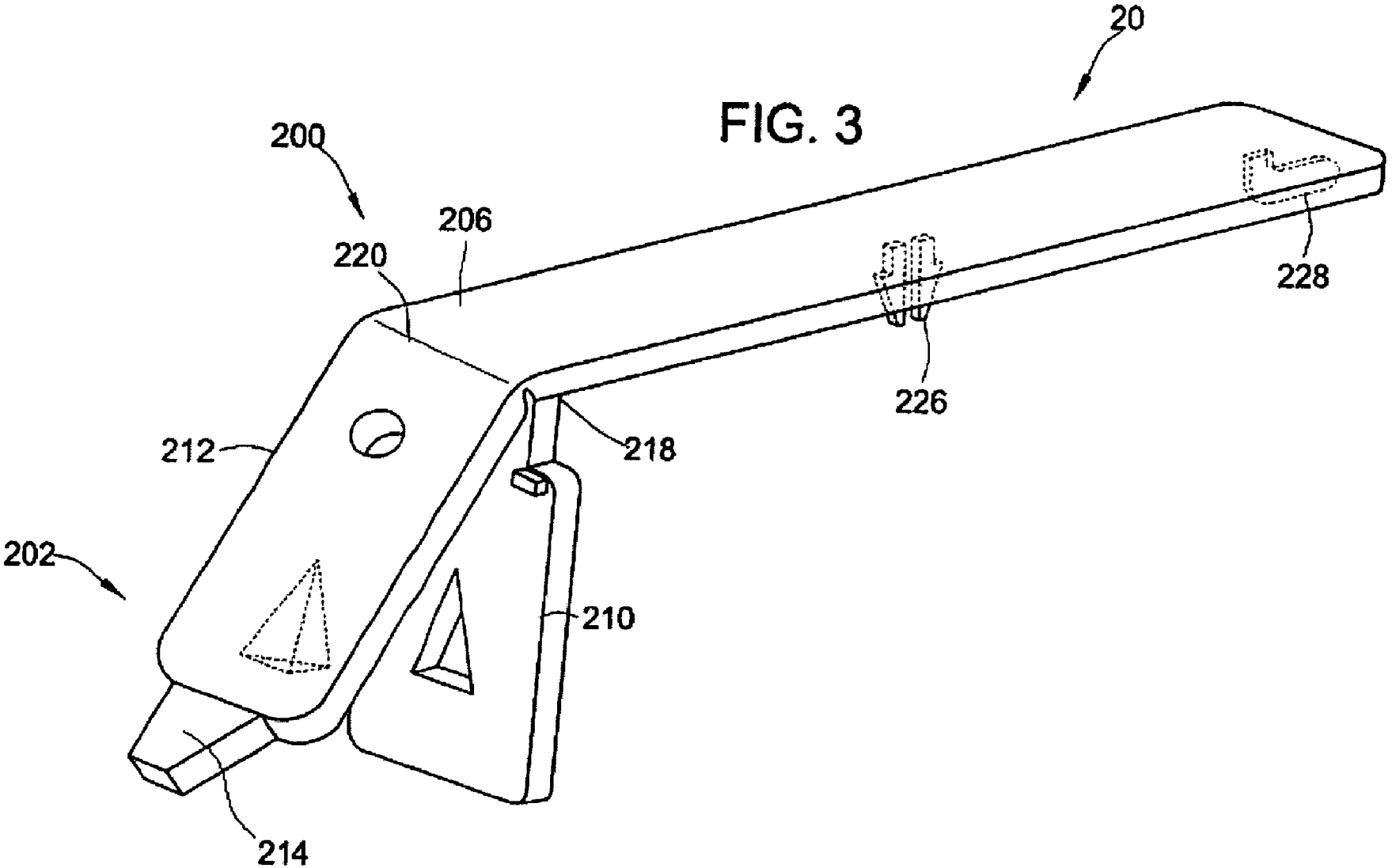
FIG. 3 is a perspective view of an alternative embodiment of the sign holder configured to hold the planar sign flush to a shelf.

In other embodiments, the clamp and the mounting leg can be configured to hold the planar sign flush to the front edge of the shelf. For example, referring to FIG. 3, the sign holder 200 is arranged so that the mounting leg 204 extends generally normal to the plane defined by the clamp 202. Specifically, the proximate edge 218 of the first panel 210 is fixedly joined to and extends along a clamp end 206 of the mounting leg 204 such that the first panel extends at a downward-oriented right angle from the rest of the mounting leg. The second panel 212, whose proximate edge 220 is pivotally connected to the proximate edge 218 of the first panel 210, remains free to pivot with respect to the mounting leg 204. Accordingly, when the second panel 212 is pivoted to the clamping position, the second panel likewise extends at a downwards right angle with respect to the mounting leg 204. Accordingly, when the mounting barbs 226 and the mounting foot 228 projecting from the mounting leg 204 are received in perforations through a horizontal ledge, as described above, it will be appreciated that a planar sign held between the first and second panels 210, 212 will be flush with the front edge of the ledge. In an embodiment, to facilitate pivoting the second panel 212, a wing 214 can extend at an angled relationship from the second panel.

Figure 4:
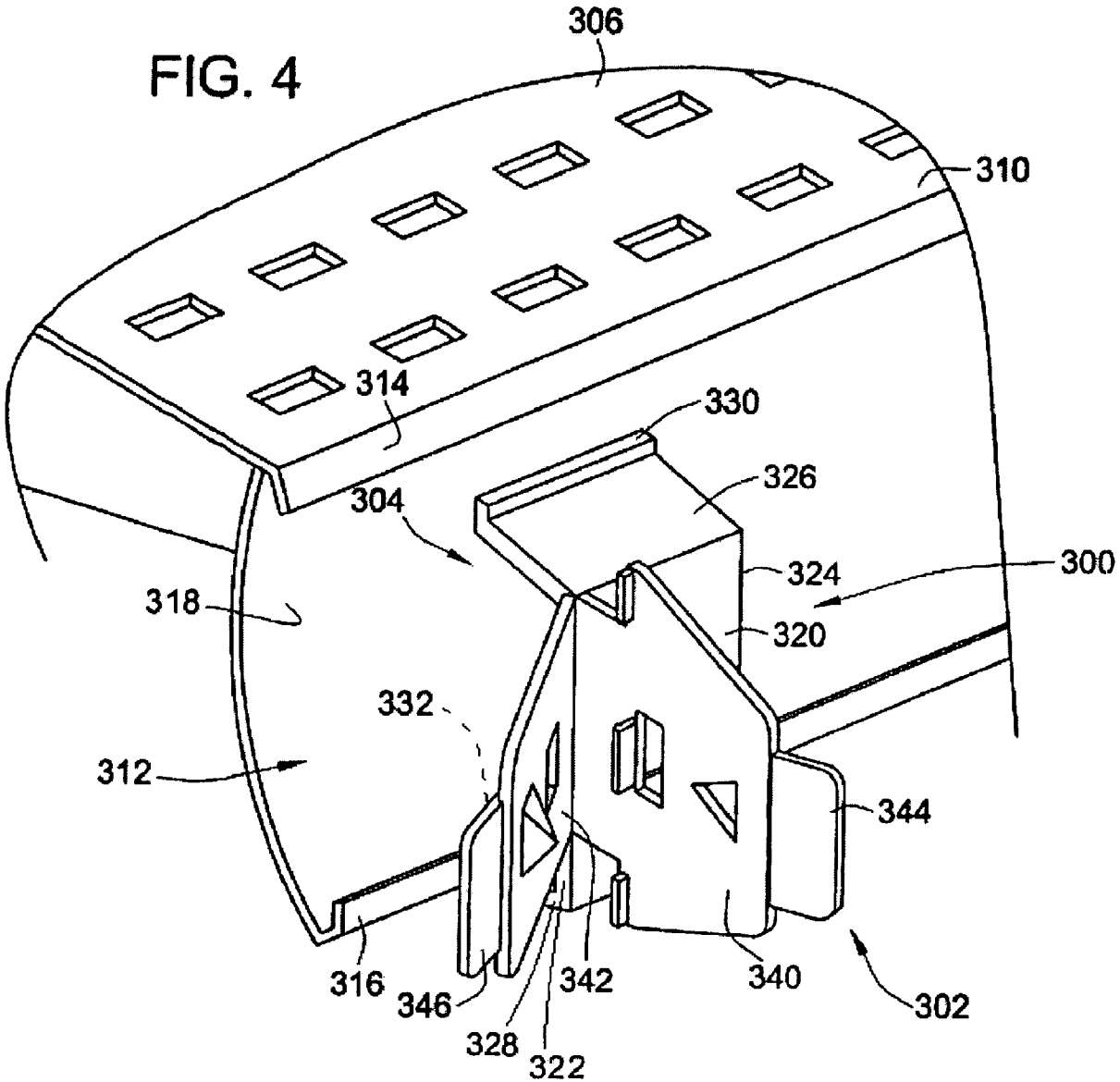
FIG. 4 is a perspective view of an embodiment of the sign holder having a mounting bracket and configured to hold the planar sign perpendicularly from a shelf.

In other embodiments, the various other mounting structures can be connected to the clamp. For example referring to FIG. 4, another embodiment of the sign holder 300 includes a clamp 302 and a mounting bracket 304 for attachment to a channel 312, such as a C-channel, disposed along the front edge 310 of a shelf 306. The mounting bracket 304 includes an intermediate member 320 that extends between a first side 322 and a second side 324. Extending in a divergent fashion from the intermediate member 320 between the first and second sides 322, 324 are a first flange 326 and a second flange 328. The first and second flanges 326, 328 terminate in respective first and second anchor feet 330, 332 that project from the flanges in opposite directions. The projecting anchor feet 330, 332 are both parallel to the intermediate member 320 and offset from the intermediate member by the flanges 326, 328.

To attach the mounting bracket 304 to the channel 312, as will be appreciated by those of skill in the art of shelf product display, the channel typically includes opposing first and second rails 314, 316 that are offset from a common curved wall 318. When attached, the first and second anchor feet 330, 332 of the flanges are received between the rails 314, 316 and the curved wall 318 thereby securing the mounting bracket 304 to the shelf 306. Preferably, the offset between the rails 314, 316 and the curved wall 318 provides a clearance fit with the anchor feet 330, 332 so that the mounting bracket 304 can slide with respect to the channel 312.

To hold the planar sign, the clamp 302 includes pivotally connected first and second panels 340, 342. In the embodiment illustrated in FIG. 4, the first and second panels 340, 342 are arranged so that the planar sign will be held perpendicularly out from the front edge 310 of the shelf 306. Specifically, the first panel 340 is rigidly attached to and extends at a right angle from the first side 322 of the intermediate member 320. The second panel 342 is pivotally attached to the first panel 340 proximate to the first side 322 of the intermediate member 320. Accordingly, the second panel 342 can pivot with respect to both the intermediate member 320 and the first panel 340. As shown, the first and second panels 340, 342 can include holding prongs and piercing prongs as described above. Moreover, to facilitate pivoting the first and second panels 340, 342, each panel has a respective first wing 344 and second wing 346 that extend at angled relationship from the panels.

Figure 5:
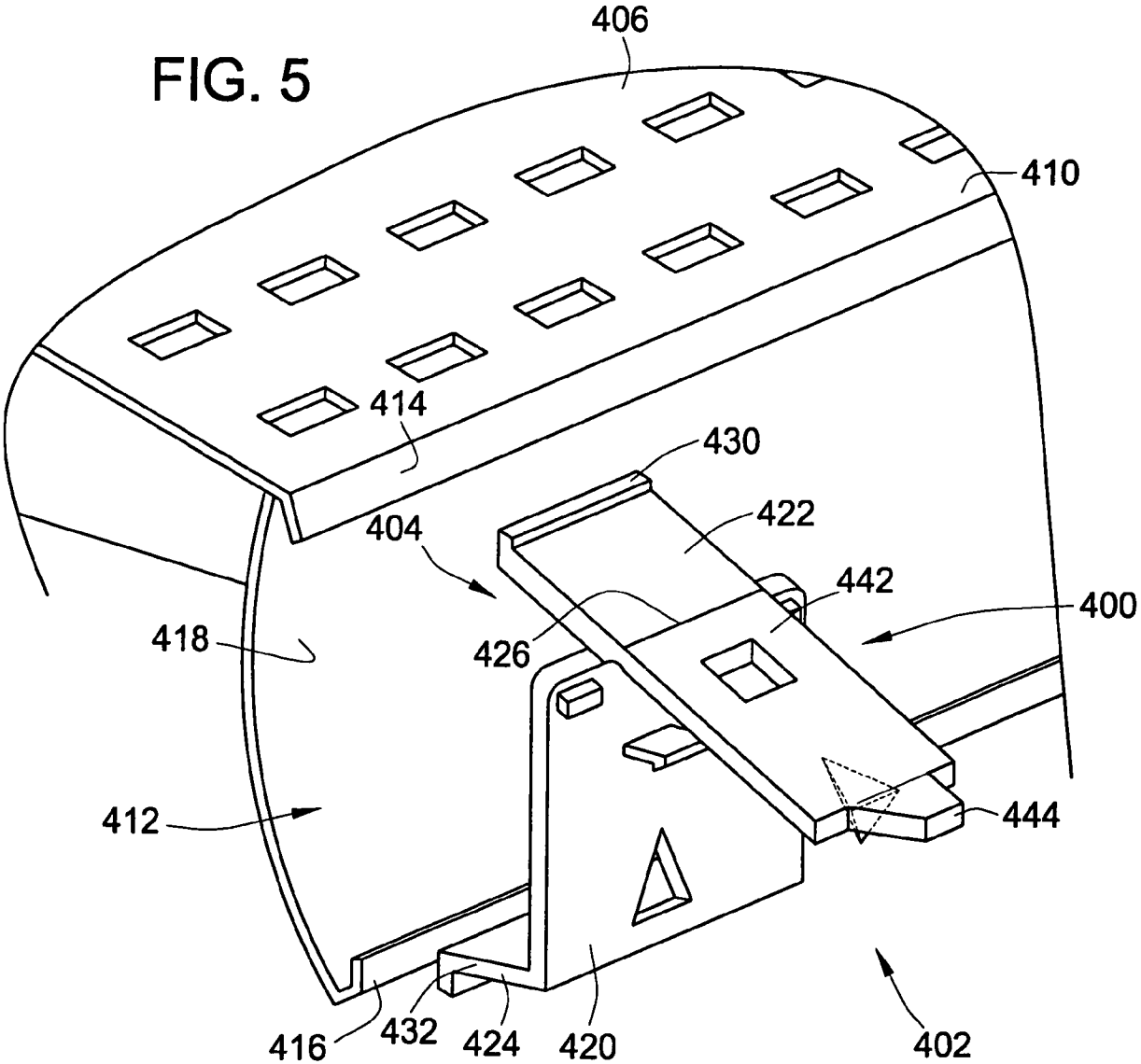
FIG. 5 is a perspective view of an embodiment of the sign holder having a mounting bracket and configured to hold the planar sign flush to a shelf.

Illustrated in FIG. 5 is an embodiment of the sign holder 400 configured to hold the planar sign flush with a channel 412 disposed along the front edge 410 of a shelf 406. The sign holder 400 includes both a clamp 402 for holding the planar sign and a mounting bracket 404 for attachment to the channel of the shelf 406. To attach the sign holder 400, as described above, the mounting bracket 404 includes an intermediate member 420 from which there divergently extends a first and a second flange 422, 424 that terminate in respective first and second anchor feet 430, 432. The anchor feet 430, 432 can be received in the space between a curved wall 418 and opposing first and second rails 414, 416.

To hold the planar sign flush, the intermediate member 420, which is rigidly attached to and extends between the first and second flanges 422, 424, also functions as the first panel. The engagement of the flanges 422, 424 and the rails 414, 416 fixes the position of the intermediate member 420 with respect to the channel 412. Pivotally attached to the intermediate member 420 at an edge 426 formed approximately by the intersection of the intermediate member and the first flange 422 is a second panel 442. Accordingly, the second panel 442 can pivot with respect to both the intermediate member 420 and the channel 412. As will be appreciated, any planar sign held between the second panel 442 and the intermediate member 420 will be flush with the front edge 410 of the shelf 406. As shown, the intermediate member 420 and the second panel 442 can include holding prongs and piercing prongs as described above. Additionally, to facilitate pivoting the second panel 442 with respect to the intermediate member 420, a wing 444 extends from the second panel at an angled relationship.

Hence, the invention provides a sign holder for mounting to and displaying from a shelf any of various planar signs. The sign holder includes a clamp having two pivotally-connected panels that can be placed into a clamping position to hold the planar sign. To hold the panels in the clamping position, the first panel includes a holding prong that can be received in a corresponding aperture of the second panel. To prevent the planar sign from slipping between the panels, the second panel includes a piercing prong that can pierce the planar sign and be received in a corresponding aperture of the first panel.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A sign holder for holding a planar sign from a shelf comprising:

a first panel;

a second panel pivotally connected to the first panel;

a projecting holding prong on one of said panels and a corresponding first aperture on the other of said panels, the holding prong having an enlarged head, the enlarged head defining a shoulder, the shoulder arranged to engage a surface of one of the panels when the holding prong is received in the first aperture;

a projecting piercing prong on one of said panels and a corresponding second aperture on the other of said panels; and wherein, when the first and second panels are pivoted relative to each other to partly overlay each other, the holding prong is received in the first aperture, and the piercing prong is received in the second aperture.

2. The sign holder of claim 1, wherein the holding prong includes a rectangular base portion adapted to abut against an edge of the planar sign placed between the first and second panels.

3. The sign holder of claim 2, wherein the first and second panels includes respective first and second proximate edges and respective first and second distal edges, the first and second panels pivotally connected along the first and second proximate edges.

4. The sign holder of claim 3, wherein the piercing prong is spaced-apart from the connected first and second proximate edges a greater distance than the holding prong is spaced apart from the connected first and second proximate edges.

5. The sign holder of claim 4, wherein the first panel includes a projecting stop adapted to abut against the edge of the planar sign placed between the first and second panels.

6. The sign holder of claim 2, wherein the first and second panels each includes respective first and second inner surfaces and respective first and second outer surfaces, the first and second apertures being disposed between the inner and outer surfaces of the respective panels.

7. The sign holder of claim 6, wherein the first aperture has a generally rectangular shape to accommodate the rectangular base portion.

8. The sign holder of claim 6, wherein the piercing prong is generally shaped as a tetrahedron.

9. The sign holder of claim 8, wherein the second aperture is generally shaped as a triangle to accommodate the piercing prong.

10. The sign holder of claim 1, further comprising a first wing extending from the first distal edge, and a second wing extending from the second distal edge, the first and second wings extend at an angled relationship with respect to the respective first and second panels.

11. The sign holder of claim 1, wherein the sign holder is comprised of polypropylene.

12. The sign holder of claim 11, wherein the first and second panels are pivotally connected by a living hinge.

13. The sign holder of claim 1, further comprising a mounting leg extending from the first panel, the mounting leg adapted to mount the sign holder to the shelf such that the second panel is pivoted.

14. The sign holder of claim 13, wherein the mounting leg is fixedly attached to the first panel and extends generally along the plane defined by the first panel.

15. The sign holder of claim 13, wherein the mounting leg is fixedly attached to the first panel and extends generally normal to the plane defined by the first panel.

16. The sign holder of claim 1, further comprising a mounting bracket having an intermediate member, a first mounting flange, and a second mounting flange, the first and second mounting flanges extending from the intermediate member at a divergent angle, the mounting bracket adapted to mount the sign holder to a channel.

17. The sign holder of claim 16, wherein the first panel is fixedly attached to and extends perpendicularly from the intermediate member.

18. The sign holder of claim 17, wherein the second panel is pivotally connected to the first panel approximately at the intersection of the first panel and the intermediate member.

19. The sign holder of claim 16, wherein the intermediate panel functions as the first panel, the intermediate panel and second panel being pivotally connected together.

20. The sign holder of claim 1, wherein the sign holder is adapted to hold the planar sign perpendicularly from the shelf.

21. The sign holder of claim 1, wherein the sign holder is adapted to hold the planar sign flush to the shelf.

22. The sign holder of claim 1, wherein the projecting holding prong is on the first panel, and wherein the piercing prong is on the second panel.

23. A sign holder for holding a planar sign from a shelf comprising:

a first panel;

a second panel pivotally connected to the first panel;

a projecting holding prong on one of said panels and a corresponding first aperture on the other of said panels;

a projecting piercing prong on one of said panels and a corresponding second aperture on the other of said panels;

wherein, when the first and second panels are pivoted relative to each other to partly overlay each other, the holding prong is received in the first aperture, and the piercing prong is received in the second aperture;

wherein the holding prong includes a rectangular base portion adapted to abut against an edge of the planar sign placed between the first and second panels;

wherein the first and second panels includes respective first and second proximate edges and respective first and second distal edges, the first and second panels pivotally connected along the first and second proximate edges;

wherein the piercing prong is spaced-apart from the connected first and second proximate edges a greater distance than the holding prong is spaced apart from the connected first and second proximate edges;

wherein the first panel includes a projecting stop adapted to abut against the edge of the planar sign placed between the first and second panels; and wherein the stop is spaced apart from the connected first and second proximate edges approximately the same distance as the holding prong is spaced apart from the connected first and second proximate edges.

24. A sign holder for holding a planar sign from a shelf comprising:

a generally planar first panel having opposing first inner and outer surfaces, a first proximate edge, and a first distal edge, the first panel including a holding prong forming an undercut surface;

a generally planar second panel having opposing second inner and outer surfaces, a second proximate edge pivotally connected to the first proximate edge, and a second distal edge, the second panel including an aperture;

a first wing extending from the first distal edge at an angled relationship to the plane of the first panel; and a second wing extending from the second distal edge at an angled relationship to the plane of the second panel;

wherein, when the first and second panels are pivoted relative to each other to partly overlay each other, the holding prong passes through the aperture, the undercut surface releasably engages the second outer surface, and the first and second wings diverge.

* * * * *